US005381591A

United States Patent [19]

Ponger et al.

[11] Patent Number: 5,381,591

[45] Date of Patent: Jan. 17, 1995

[54] MULTI-TIER BURIAL SYSTEM

[76] Inventors: Uri Ponger, 4 Tel-Hai St., Jerusalem; Tuvia Sagiv, 23 Shtand St., Tel Aviv, both of Israel

[21] Appl. No.: 959,734

[22] Filed: Oct. 13, 1992

[30] Foreign Application Priority Data

Nov. 8, 1991 [IL] Israel ..... 100012
Jun. 30, 1992 [IL] Israel ..... 102373

[51] Int. Cl.[6] ..... A61G 17/00

[52] U.S. Cl. ..... 27/35; 27/3; 52/136; 52/79.2

[58] Field of Search ..... 27/35, 3, 2, 1; 52/136, 52/137, 139, 140, 141, 142, 134, 79.2, 604, 608; 47/82, 83; 405/284, 286

[56] References Cited

U.S. PATENT DOCUMENTS 3,878,656 5/1975 Duwe et al. ..... 52/134
3,958,378 5/1975 Omeechevarria ..... 52/136
4,102,098 7/1978 Duwe et al. ..... 52/140
4,379,659 4/1983 Steiner ..... 52/608
4,671,706 6/1987 Giardini ..... 52/608
4,989,382 2/1991 Spronken ..... 52/136
5,081,805 1/1991 Jazzar ..... 52/79.2

*Primary Examiner*—Carl D. Friedman
*Assistant Examiner*—Kien Nguyen
*Attorney, Agent, or Firm*—Silverman, Cass & Singer, Ltd.

[57] ABSTRACT

The invention provides a multi-tier burial system comprising a plurality of precast elements, a first plurality of the elements being aligned to form a first tier defining a plurality of spaced-apart burial niches, and a second plurality of the elements being aligned to form a second tier supported by the first tier also defining a plurality of spaced-apart burial niches, the niches in the second tier being vertically staggered in relation to the niches in the first tier.

10 Claims, 5 Drawing Sheets

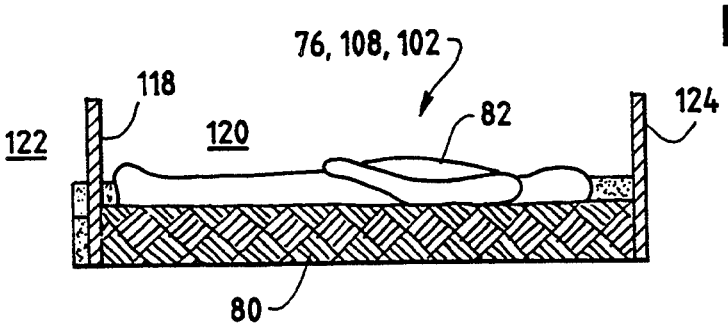
Fig. 8
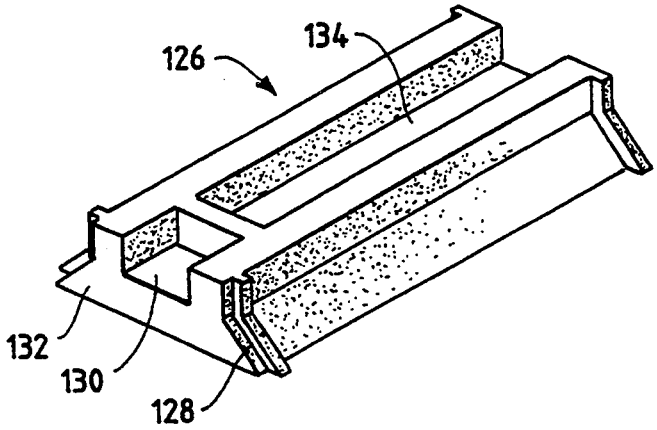
Fig. 9
Fig. 10
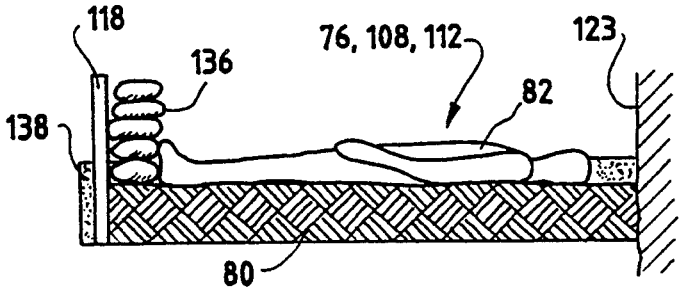
Fig. 11
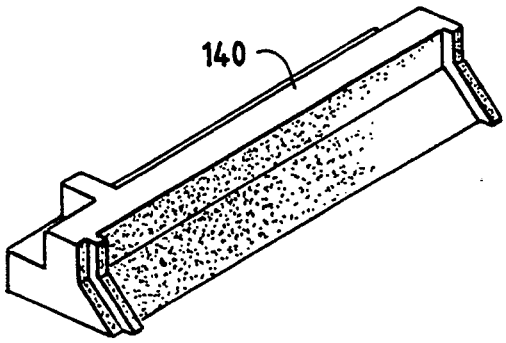

MULTI-TIER BURIAL SYSTEM

The present invention relates to a multi-tier burial system. More particularly, the invention is concerned with providing a burial system which allows for the individual burial in earth of deceased persons in an area significantly smaller than is presently required by the conventional arrangement Burial methods are chosen according to civil law, religious law or custom and also according to the wishes of the surviving relatives of the deceased. While certain burial methods such as cremation and burial at sea require no land area at all, the present invention relates to the widely practiced burial method among Jews, Christians and Muslims where land must be allocated for burial of the deceased in a grave.

While the system of the present invention conforms to the requirements of the Jewish religious law, in particular as stated in the Shulchan Aruch, Yoreh Deah, Chapter 362, it will also be applicable in non-Jewish societies where dignified burial is required but low-cost land is no longer available for this purpose.

Many burial societies, Jewish and non-Jewish, in Israel and abroad, are faced with rapidly filling cemeteries and a near impossibility of being able to purchase suitable land for expansion, particularly within reasonable proximity to the large cities. Furthermore, even where such land has been found, residents in its vicinity object vehemently to the establishment of a new cemetery near their homes.

Graves are considered permanent resting places, in Jewish as well as other societies, and with each new generation, further pressure on land use becomes apparent. As an example of land requirements, with death rates of about 10 per thousand per year, and a burial density of 1000 graves per acre, that is about 250 per 1000 square meters, a city such as Tel-Aviv will require 160 extra acres of land within about 15 years. The tasks of finding and financing the purchase of such a plot in a suitable area are daunting indeed, and the need is apparent to raise burial density while yet maintaining individual graves in a manner that not only conforms to Jewish religious law but also meets the reasonable expectations of the family of the deceased for dignified burial.

It is therefore one of the objects of the present invention to obviate the disadvantages of the prior art burial systems and to provide a system which provides increased burial density without infringing either Jewish religious law or the dignity of the deceased.

It is a further object of the present invention to provide a burial system which will make possible the building of small-area cemeteries in or near urban centers, the visual impact thereof being sufficiently moderate that adjoining residents will accept the location of such a cemetery near their homes or businesses.

This present invention achieves by providing a multi-tier burial system comprising a plurality of precast elements, a first plurality of said elements being aligned to form a first tier defining a plurality of spaced-apart burial niches, and a second plurality of said elements being aligned to form a second tier supported by said first tier also defining a plurality of spaced-apart burial niches, the niches in said second tier being vertically staggered in relation to the niches in said first tier.

In a particularly preferred embodiment of the present invention there is provided a system wherein said elements are elongated precast members having an outwardly diverging base formed of an elongated side-to-side-symmetrical trapezoidal prism extending along a horizontal axis, the roof of said prism forming the base of a rectangular-section extension aligned in parallel to the axis of said prism. Elements of this form may advantageously be combined by inverting an upper element and positioning it atop a lower element.

In another preferred embodiment of the present invention there is provided a multi-tier burial system comprising a plurality of precast units, each of these units being formed as an earth-containing box-like element, a first plurality of such elements being aligned in spaced-apart relationship to form a first tier, and a second plurality of said elements being aligned in spaced-apart relationship to form a second tier supported by the first tier and horizontally staggered with relation thereto, elements of the second tier straddling the spaces formed between two adjacent elements of a lower tier and being respectively supported by two lower elements, wherein the bottom of an upper element and the interfacing sides of two adjacent lower elements which support said upper element delimit three surfaces of a burial niche.

In this embodiment said units are preferably trapezoidal in cross-section.

The present invention further makes provision for hermetically sealing the aperture through which the deceased was inserted.

In certain exceptional circumstances it is required to remove the body of the deceased after burial. For example, a Jewish deceased person may have been buried in the diaspora, and at a later date it may be desired to rebury the deceased in Israel. The burial system of the present invention is inherently suited to this requirement, as no excavation is required to carry out such a transfer, and the danger of damaging the remains of the deceased is obviated.

The present invention is of particular utility in cemetries situated on hillsides. For example, in Jerusalem a cemetry requiring to prepare a section of flat land must pay the high costs of erecting retaining walls up to 14 meters high. In application of the present invention, such walls need be no more than 3 meters high.

An outdoor four-tier system according to the present invention makes possible the burial of approximately 1000 persons per 1000 square meters. In purpose-designed cemetry buildings tens of tiers are feasible, and the burial density achieved will be correspondingly greater.

Here it is to be mentioned that the system described in the present specification has been unanimously approved as conforming to Jewish religious law by the Chief Rabbinical Counsel of Israel. The system has also been approved by the Israeli Ministry of Health.

The inventors of the present system have previously proposed, had approved and erected multi-story burial sites as reported in news articles over the last few years.

Thus, as described e.g., in the Architects' Journal, Mar. 7, 1990, a project consisting of erecting artificial hills 6 to 8 meters high in which caves are dug to provide multi-story graves was approved by the rabbinical authorities.

Where the region is hilly, terraces are built on the slopes and burial slots are set into the vertical retaining wall of the terraces, erected for this purpose.

In contradistinction to said previous proposals which involved excavating burial slots with the expense involved and the care needed to avoid collapse of these artificially created niches and retaining walls, the present invention enables the simple erection of a multi-tiered burial site from preformed units which are readily mass produced, transported and erected on site.

The invention will now be described in connection with certain preferred embodiments with reference to the following illustrative figures so that it may be more fully understood.

With reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

In the drawings:

FIG. 8 is a longitudinal cross-sectional view of a burial niche provided with an arrangement for sealing same after the insertion of a deceased person;

FIG. 9 is a perspective view of a single element of a preferred embodiment of the system;

FIG. 10 is a longitudinal cross-sectional view of a burial niche provided with a further method of sealing same after the insertion of a deceased person;

FIG. 11 is a perspective view of a small element which can be used to construct a multi-tier burial system;

Figure 1:
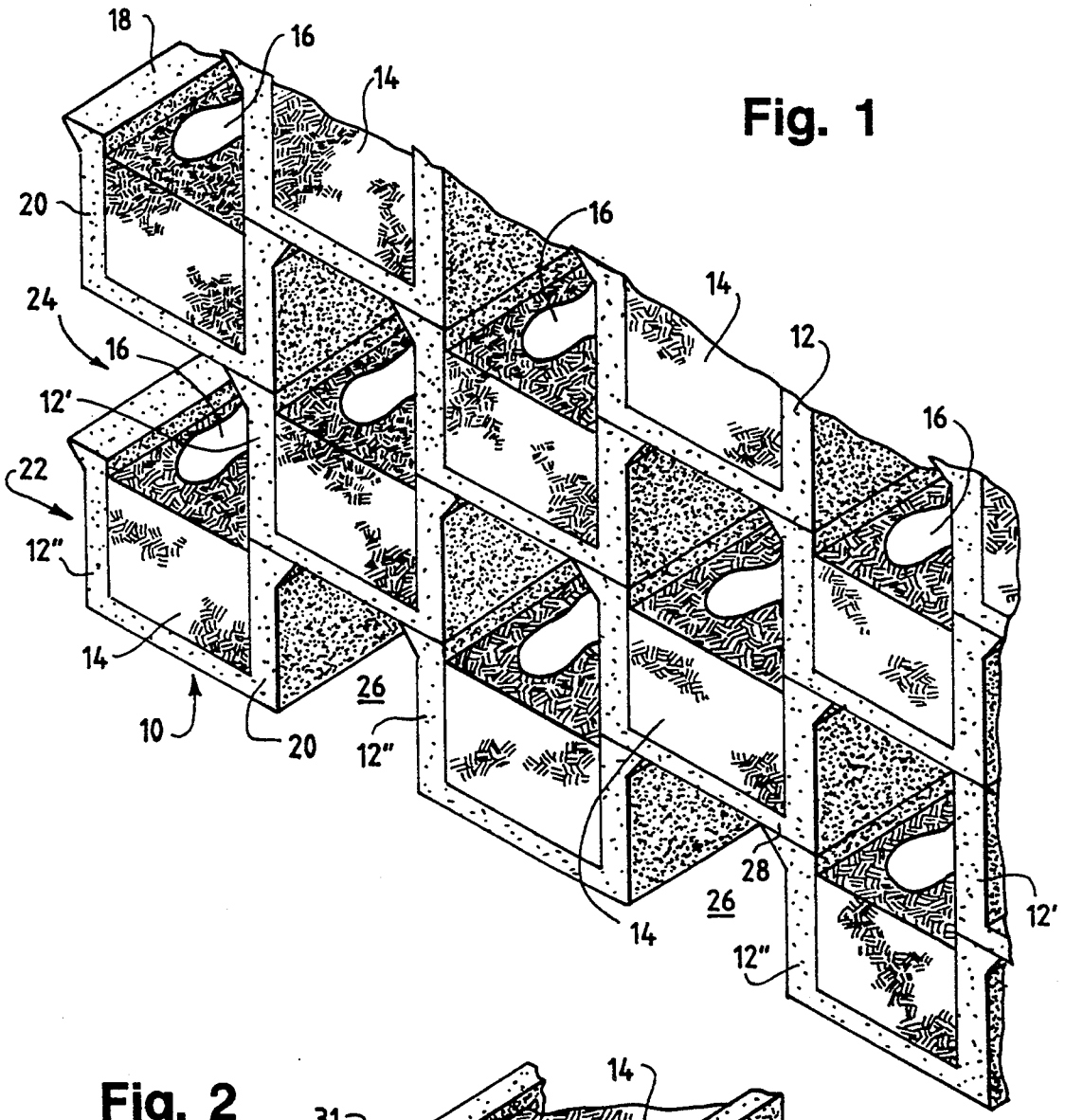
FIG. 1 shows a perspective, fragmented, cross-sectional view of a first embodiment of the invention.

There is seen in FIG. 1 a plurality of precast units 10, each unit 10 being formed as an earth-containing box-like element, 12, 12', 12''. The preferred material of construction for the element 12 is concrete, its length being 2 to 2.5 meters, with a wall thickness of 3 to 8 centimeters. Each element 12 is filled with earth 14 to a depth of 50 to 60 centimeters. The deceased 16 is laid to rest on top of the earth 14.

The upper edges 18 of the sides 20 are preferably widened as shown in the drawing, thereby providing good support for a higher tier and providing further separation between the burial spaces of a first tier and diagonally removed burial spaces of a further tier in order to comply with requirements of the Jewish religious law.

A first plurality of elements 12' are aligned in spaced-apart relationship to form a first tier 22, and a second plurality of elements 12' are aligned in spaced-apart relationship to form a second tier 24 supported by the first tier 22 and horizontally staggered with relation thereto. Elements 12' of the second tier 24 straddle the spaces 26 formed between two adjacent elements 12'' of the lower first tier 22 and are respectively supported by two lower elements 12'', wherein the bottom 28 of an upper element 12' and the interfacing sides 20 of two adjacent lower elements 12'' which support said upper element 12' delimit three surfaces of the space 26 which forms a burial niche. The space 26 is in all embodiments hermetically sealed following the insertion of a deceased 16, as will be described with reference to FIG. 4.

As will be realized and as can be readily calculated e.g., in a five-tier system according to the present invention, burial density is approximately six times greater than in conventional systems.

Figure 2:
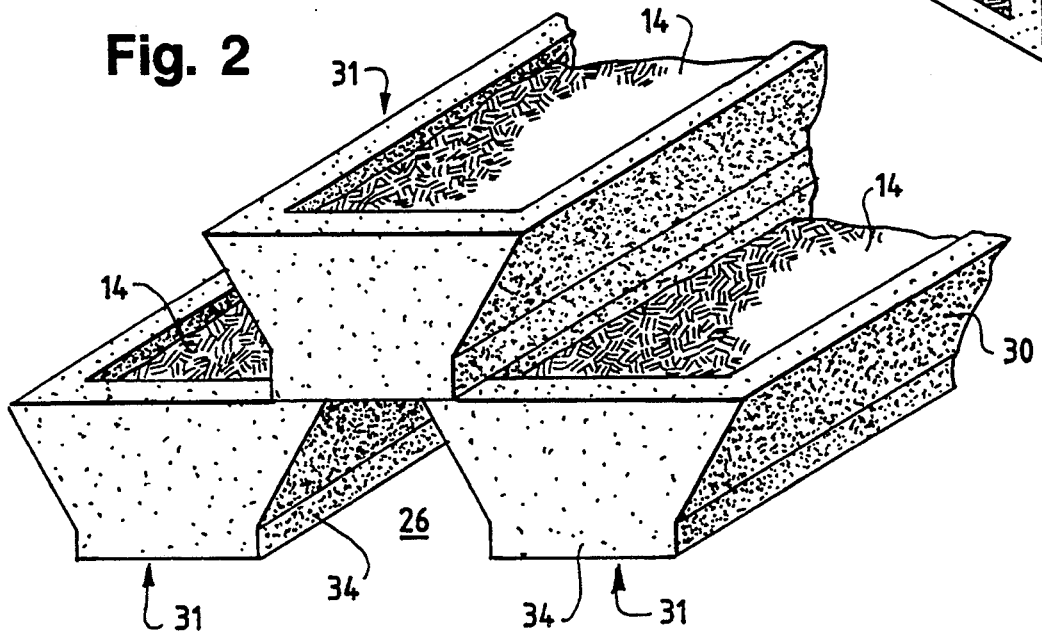
FIG. 2 is a perspective fragmented view of three units of a second, preferred embodiment.

Further improvement in density is achieved by sloping the walls 30 of units 31, as is shown in FIG. 2. This figure shows a system generally similar that shown in FIG. 1, but the precast units 31 are trapezoid in cross-section.

The resultant burial density is thereby increased by approximately a further 40%, as compared with the system of niches previously proposed by the present inventors.

The width of the trapezoid at its upper, open face 32 is about 70 centimeters, while the width at its base 34 is about 55 centimeters. The base 34 is preferably widened as shown to improve seating of upper units 31 on lower units.

Figure 3:
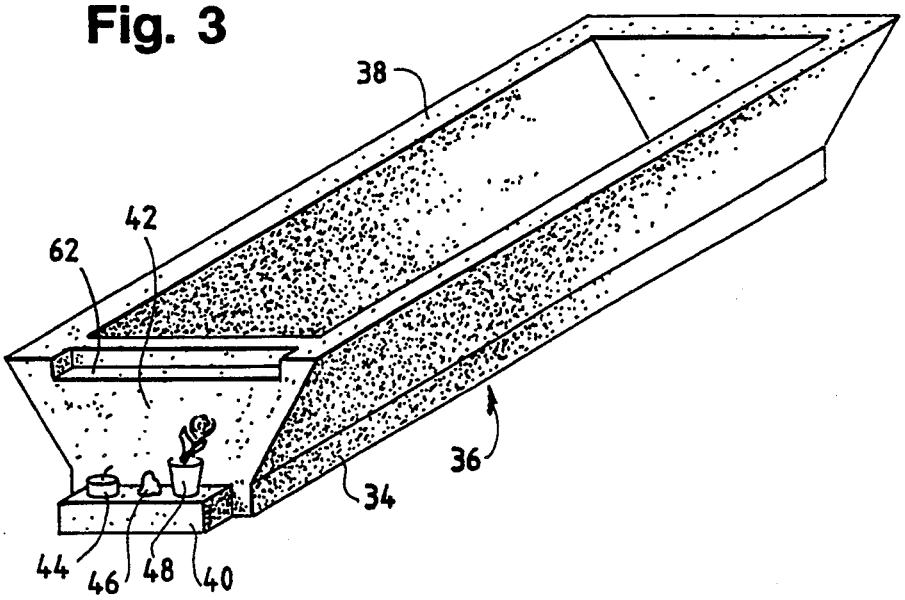
FIG. 3 is a perspective view of an individual unit of a third embodiment.

FIG. 3 shows an individual unit 36 of a third embodiment. Again, the pre-cast unit 36 is formed as an earth-containing box-like element 38 of trapezoidal cross-section of similar dimensions as described with regard to FIGS. 1 and 2. However, there is additionally provided a horizontal ledge 40 projecting outwardly beyond an end wall 42, the ledge 40 serving as a shelf which is suitable for the placement of a memorial light 44 or other article such as a stone 46 or flowers 48, however is customary.

Figure 4:
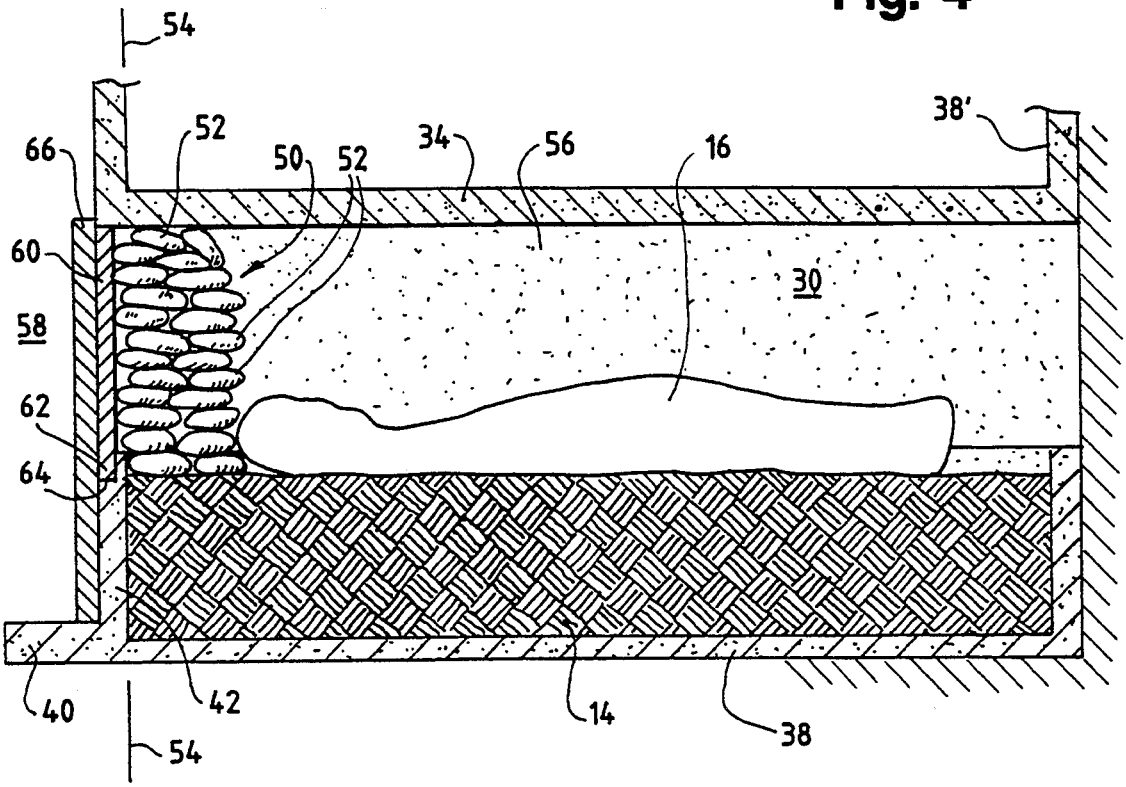
FIG. 4 is a longitudinal cross-sectional view of a unit which has been sealed after the insertion of a deceased person.

There is seen in FIG. 4 the element 38 as it appears after having been sealed following the insertion of a deceased person 16. A wall 50 of earth-filled sacks 52 is erected in the vertical plane 54 in proximity to the end wall 42. The wall 50 extends to contact the base 34 of an upper element 38' as well as the side walls 30 of adjacent elements thereby sealing the space 56 containing the deceased 16 from the space 58 accessible to visitors.

A tablet of stone or other suitable material 60, typically about 60 centimeters square, is then hermetically sealed along its edges to close the previously-existing aperture on the plane 54.

Preferably a recess 62 is provided in the end wall 42 for the insertion of a tablet 60, the joint being secured by a sealant 64. A granite or marble memorial plaque 66, standard size for all burial niches in an array, painted and/or engraved as is customary with gravestones, is attached to the end wall 42 and to the tablet 60. This may be carried out optionally several months after the burial of the deceased, as is customary with tombstones.

The size of the plaque 66 will be about 90 to 110 centimeters high and 60 to 90 centimeters wide. Preferably each plaque 66 makes edge contact with each adjacent plaque, vertically and horizontally. The plaque 66 covers at least a substantial part of the area of the end wall 42 and of the hermetically-sealed stone table 60. The plaque 64 thereby serves not only its traditional purpose but also acts as a third barrier, after the stone tablet 60 and the wall 50 in separating the space 56 occupied by the deceased 16 and the space 58 accessible to visitors.

The system of the present invention may be applied to an excavated area of a cemetery, to a natural or man-made side slope, or to a specially built cemetery building or artificial hill. In all cases walkways (not shown) are provided to enable visitors to approach each grave at whatever level it is located.

Figure 5:
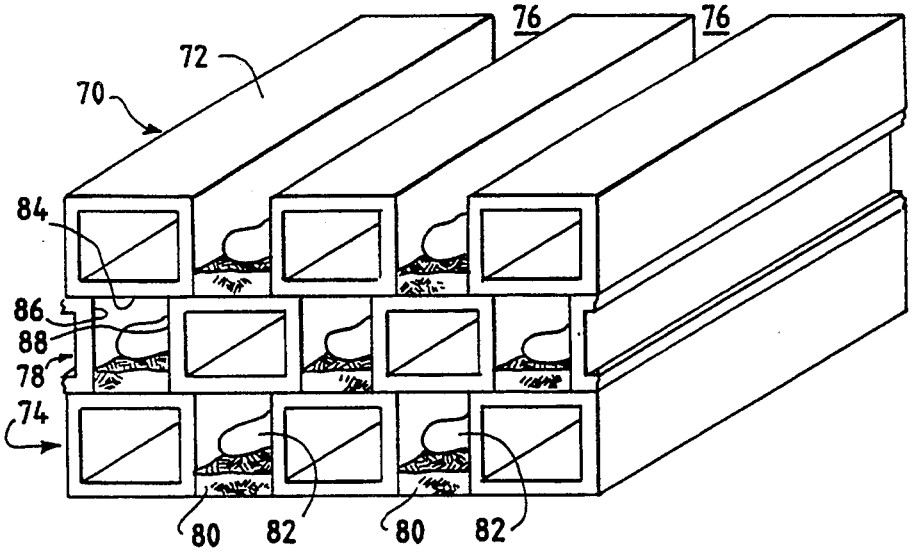
FIG. 5 shows a perspective fragmented view of a multi-tier burial system in a fourth embodiment of the invention.

There is seen in FIG. 5 a multi-tier burial system 70 comprising a plurality of precast elements 72, shown in this embodiment as rectangular section tubes, which may suitably be cast using concrete.

The elements 72 are about 2 to 2.5 meters in length, and are provided with walls about 4 to 6 centimeters in thickness.

The elements 72 can readily be mass produced by conventional processes.

A first, lower plurality of elements 72 are aligned to form a first tier 74, the spaces between the elements 72 defining a plurality of spaced-apart burial niches 76. A second plurality of elements 72 are aligned to form a second tier 78 supported by the first tier 74, also defining a plurality of spaced-apart burial niches 76. The niches 76 in said second tier 78 are vertically staggered in relation to the niches 76 in the first tier 74.

The niches 76 are filled with earth 80 to a depth of 20 to 50 centimeters, and deceased persons 82 are placed on the earth 80; it is not essential to cover the deceased with earth 80, as the burial niche 76 is hermetically sealed as will be described. This arrangement makes convenient the later transfer of the remains of the person 82, should it be decided to move said remains for reburial.

As shown, the elements 72 of the second tier 78 are arranged to straddle spaces formed between two adjacent elements of a lower tier 74 and to be respectively supported by said lower elements. Consequently the bottom 84 of an upper element 72 and the interfacing sides 86, 88 of two adjacent lower elements 72 which support the upper element 72 delimit the surfaces of a burial niche 76, and the complete array is formed using only a single element form.

The system of the present invention may be applied to an excavated area of a cemetry, to a natural or man-made side slope, or to a specially built cemetry building. In all cases walkways (not shown) are provided to enable visitors to approach each grave at whatever level it is located.

Figure 6:
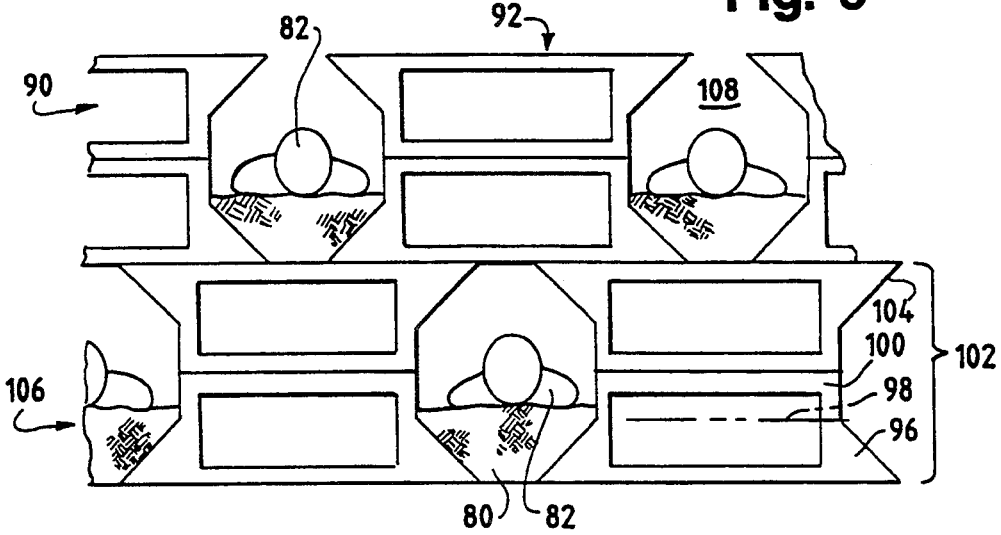
FIG. 6 is an end view of a fifth preferred embodiment wherein the precast members have an elongated base.

FIG. 6 shows a burial system 90 composed of a plurality of elongated precast member 92 having an outwardly diverging base 94 formed of an elongated side-to-side-symmetrical trapezoidal prism 96 extending along a horizontal axis. The roof 98 of the prism 96 forms the base of a rectangular-section extension 100 aligned in parallel to the axis of the prism 96. In comparison to the simple rectangular element previously described, the member 92 has several advantages; it is smaller, more aesthetically pleasing and requires less earth 80 for any given fill height.

In use, the member 92 is inverted and superposed atop an identical member to form a composite element 102. The side surfaces 104 of the composite element 102, when placed adjacent to additional composite elements 102 to form a burial tier 106, together with the side surface 104 of said adjacent composite elements, delimit the surfaces of a burial niche 108.

The height of the rectangular section extension 100 is preferably equal to half the vertical height of the trapezoidal prism 96. Consequently two spaced-apart composite elements 102 may be used to delimit the surfaces of an octagonal-section burial niche 108.

Figure 7:
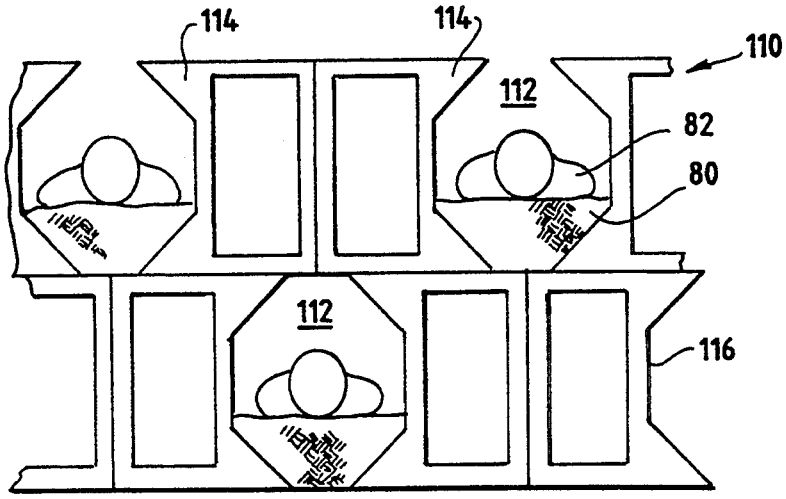
FIG. 7 is an end view of a sixth preferred embodiment wherein the precast members are the full height of the burial niche.

FIG. 7 shows a further multi-tier burial system 110 providing burial niches 112 of identical shape, size and spacing to those described with reference to FIG. 6. However the precast element 114 used for building the system 110 comprise horizontally elongated blocks of a height equal to the height of the burial niche 112 to be provided, at least one side wall 116 being recessed to delimit one side of a burial niche 112 of a desired form. The element 114 has the advantage of being somewhat more convenient to use, as it is not necessary to lift and invert elements during construction of a single tier.

Shown in FIG. 8 is the burial niche 76, 108, 112 of any of the multi-tier burial systems previously described, and showing a method of sealing said niche.

A tablet 118 is hermetically sealed along its edges to close said burial niche and so to separate the space 120 containing the body of the deceased person 82 from the space 122 providing access to visitors. A silicone-based sealant is suitable for this application. A granite or marble memorial plaque not shown, of standard size for all burial niches in an array, painted and/or engraved as is customary with gravestones may be placed in front of sealing tablet 118.

Where the multi-tier system abuts and is sealed to a natural or man-made vertical surface as shown at 123 in FIG. 10, there is no need to provide additional sealing of the rear end of the burial niche. Where the rear end of the system is not so closed, a second stone tablet 124 may be used for sealing the rear end; the tablet 124 need not be inscribed unless access is provided to the public also to said rear side.

FIG. 9 shows a single element 126, similar to member 92 described with reference to FIG. 6, as used in a multi-tier burial system. The element 126 is provided with a recessed step 128 (shown in FIG. 6) along a corner facing the front of the burial niche 108. The step 128 is configured to locate and facilitate the assembly and sealing of a stone table 118 (shown in FIG. 8) to a plurality of similar element delimiting the burial niche 108 (shown in FIG. 6).

A recess 130 is provided in the front face 132 of the element 126. The recess 130 remains open also after element 126 are assembled to form a multi-tier burial system. The recess 130 is available as a receptacle for stones, a memorial candle, flowers or whatever other objects visitors may wish to leave at the grave of a deceased relative in his honour, according to prevailing custom. An elongated recess 134 is provided for weight reduction purposes.

FIG. 10 again shows the burial niche 76, 108, 112 of any of the previously described systems. A wall of earth-filled sacks 136 is shown erected between the body of the deceased 82 and the aperture 138 through which said body was inserted after prior removal of sealing tablet 118 after which said tablet is repositioned and re-sealed.

Figure 12:
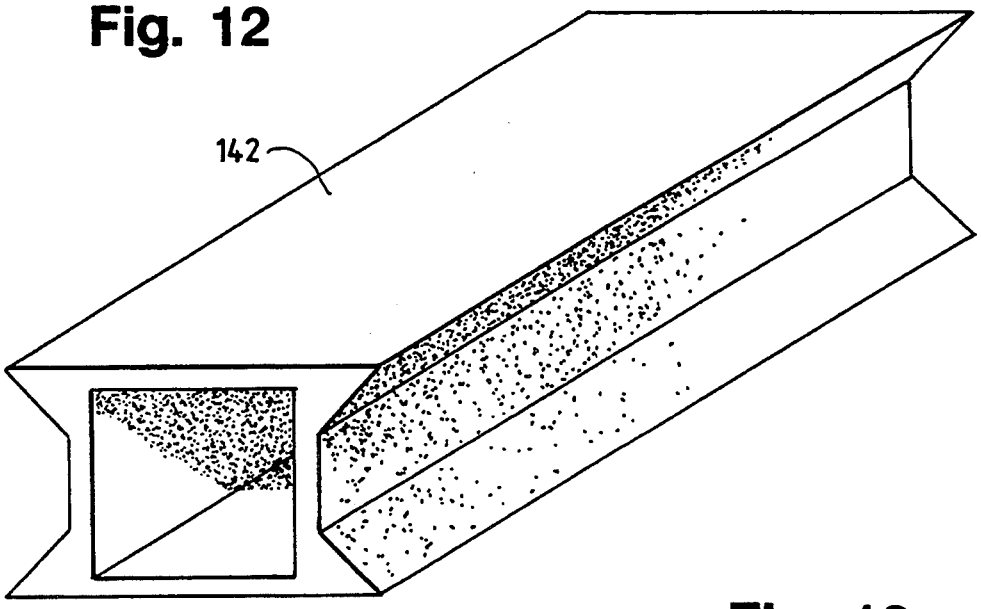
FIG. 12 is a perspective view of a large element which can be used to construct a multi-tier burial system.

FIG. 11 shows a precast element 140 which comprises one half of the element 114 described with reference to FIG. 7 and is used in the same manner except that four such elements are required between each burial niche. The element 120 offers the advantage of being much lighter and easier to handle during construction. However where heavy lifting equipment is readily available, it may be more convenient to build the burial system with large elements 142 as seen in FIG. 12. Only one such element is required between adjacent burial niches.

Figure 13:
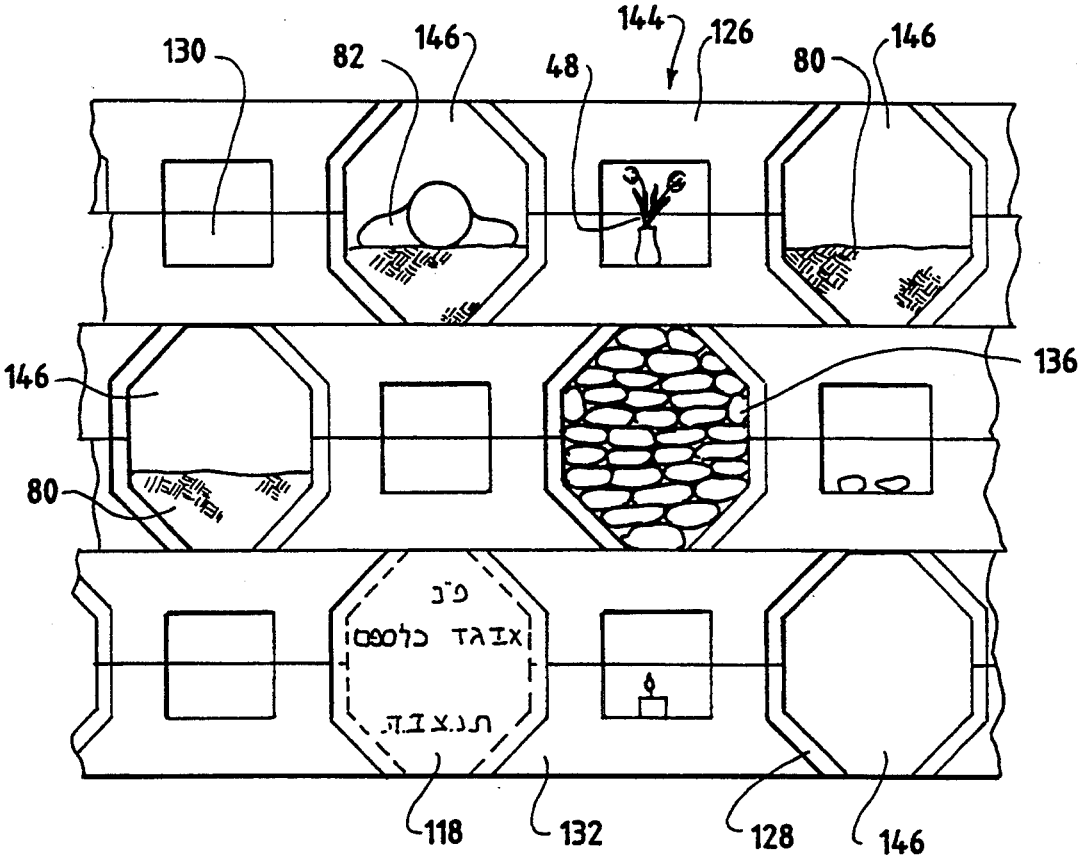
FIG. 13 is a front elevation of such system, showing how burial niches are spaced.

Lastly, FIG. 13 shows a multi-tier system 144 built using element 126 described with reference to FIG. 9. Burial niches 146 of vertically elongated octagonal shape are formed.

Here it is to be noted that centre to centre spacing of burial niches exceeds 120 centimeters in both the vertical and horizontal directions, and diagonal centre to centre spacing exceeds 90 centimeters. Such spacing equals or exceeds the requirements specified by Jewish religious law, and yet provides very substantial land-use savings in comparison to conventional burial It will be evident to those skilled in the art that the invention is not limited to the details of the foregoing illustrated embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A multi-tier burial system comprising a plurality of precast elements, each of said elements having a bottom, side walls, and front and back end walls, a first plurality of said elements being disposed to form a first tier defining a plurality of spaced-apart burial niches, and a second plurality of said elements being disposed to form a second tier supported by said first tier, also defining a plurality of spaced-apart burial niches, the elements in said second tier being horizontally staggered in relation to the elements in said first tier, and at least the front end walls of said elements in said first and second tiers being substantially in the same vertical plane with each other, said pre-cast elements being filled with earth to a predetermined depth.

2. A multi-tier burial system as claimed in claim 1, wherein said precast elements of said second tier are arranged to straddle spaces formed between two adjacent elements of said first tier and to be respectively supported by said elements of said first tier, whereby the bottom of an upper element and the interfacing sides of two adjacent elements of said first tier which support said upper element delimit the surfaces of a burial niche.

3. A multi-tier burial system as claimed in claim 1, wherein centre to centre spacing of burial niches exceeds 120 centimeters in both the vertical and horizontal directions, and diagonal centre to centre spacing exceeding 90 centimeters.

4. A multi-tier burial system as claimed in claim 1, wherein each of said precast elements being formed as an earth-containing box-like element, said precast elements of said second tier straddling the spaces formed between two adjacent elements of said first tier and being respectively supported by two elements of said first tier, wherein the bottom of an upper element and the interfacing sides of two adjacent elements of said first tier which support said upper element delimit three surfaces of a burial niche.

5. A multi-tier burial system according to claim 4, wherein said precast elements are trapezoid in substantially vertical cross-section.

6. A multi-tier burial system according to claim 1, wherein said elements are about 2 to 2.5 meters in length.

7. A multi-tier burial system according to claim 1, wherein said elements are provided with walls about 3 to 8 centimeters in thickness.

8. A multi-tier burial system according to claim 1, further comprising a wall of earth-filled sacks erected between a body of an deceased and an aperture through which said body is inserted.

9. A multi-tier burial system according to claim 8, wherein a tablet is hermetically sealed along said tablet's edges to close said aperture and so to separate the space containing said sacks and the space providing access to visitors.

10. The multi-tier burial system of claim 1 wherein said niches are filled with said earth to a depth of 20 to 50 centimeters.

* * * * *